US007331827B2

(12) United States Patent
Gleissner et al.

(10) Patent No.: US 7,331,827 B2
(45) Date of Patent: Feb. 19, 2008

(54) ELECTRICAL CONNECTOR WITH AN ANTI-SPLAY FERRULE

(75) Inventors: Brian Christopher Gleissner, Woodbury, CT (US); Kenneth Capozzi, Navgatuck, CT (US); Michael Andrew Hoyack, Sandy Hook, CT (US); Gino Antonini, New Fairfield, CT (US); Hardik Parikh, Danbury, CT (US); Owen Barthelmes, Cortlandt Manor, NY (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 11/442,960

(22) Filed: May 31, 2006

(65) Prior Publication Data

US 2007/0281552 A1 Dec. 6, 2007

(51) Int. Cl.
*H01R 13/64* (2006.01)

(52) U.S. Cl. ..... 439/680; 439/275

(58) Field of Classification Search ..... 439/680, 439/271, 273, 275, 586–588
See application file for complete search history.

(56) References Cited

U.S. PATENT DOCUMENTS

| | | | | |
|---|---|---|---|---|
| 4,449,776 | A | 5/1984 | Carmo et al. | |
| 4,643,506 | A * | 2/1987 | Kobler | 439/271 |
| 4,764,129 | A | 8/1988 | Jones et al. | |
| 4,925,398 | A | 5/1990 | Samejima et al. | |
| 5,024,608 | A | 6/1991 | Heng et al. | |
| 5,342,226 | A | 8/1994 | Hayes et al. | |
| 5,382,177 | A | 1/1995 | Hutchinson, Jr. et al. | |
| 5,607,318 | A * | 3/1997 | Wakata et al. | 439/274 |
| 5,660,566 | A * | 8/1997 | Ohsumi | 439/587 |
| 5,662,336 | A * | 9/1997 | Hayashi et al. | 277/607 |
| 5,692,923 | A | 12/1997 | Sawada et al. | |
| 5,890,931 | A | 4/1999 | Ittah et al. | |
| RE37,296 | E | 7/2001 | Peterson | |
| 6,273,729 | B1 | 8/2001 | Kelly et al. | |
| 6,305,849 | B1 * | 10/2001 | Roehrs et al. | 385/59 |
| 6,855,006 | B2 | 2/2005 | Brooks et al. | |
| 2003/0096527 | A1 | 5/2003 | Greiner | |
| 2004/0110425 | A1 | 6/2004 | Miyake et al. | |
| 2004/0157498 | A1 | 8/2004 | Hall et al. | |
| 2004/0157499 | A1 * | 8/2004 | Nania et al. | 439/680 |
| 2004/0259416 | A1 * | 12/2004 | Kodama et al. | 439/578 |

* cited by examiner

*Primary Examiner*—Hae Moon Hyeon
(74) *Attorney, Agent, or Firm*—Blank Rome LLP

(57) ABSTRACT

An electrical connector includes a female housing configured to include a first mating interface adapted to receive a second mating interface; a male housing configured to include the second mating interface; and at least one first anti-splay ferrule positioned at least one of the female housing and the male housing. An electrical connection is achieved when the first mating interface receives the second mating interface.

21 Claims, 12 Drawing Sheets

FIG. 4
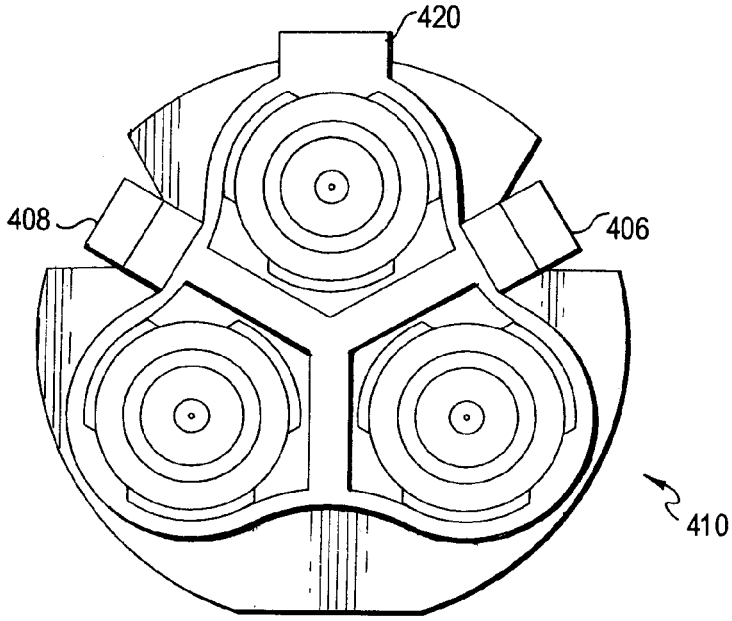
FIG. 11(D)
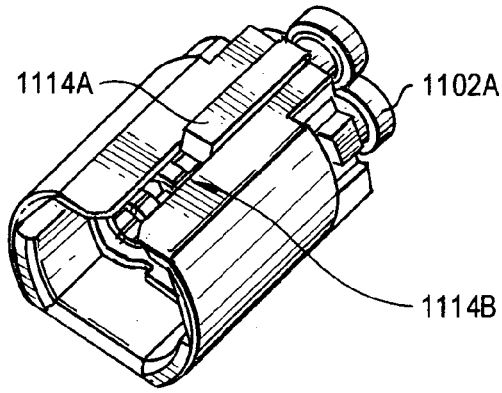
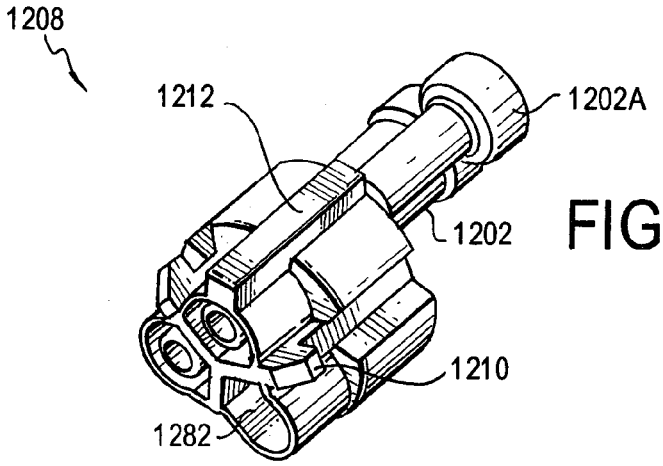
FIG. 12(D)

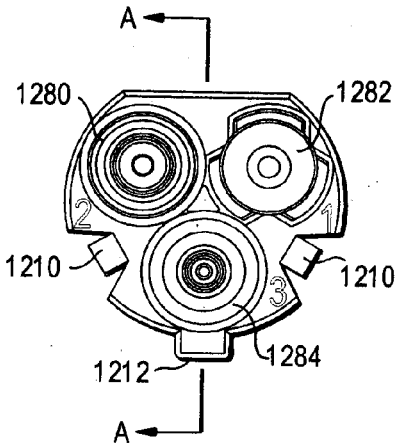
FIG. 12(A)
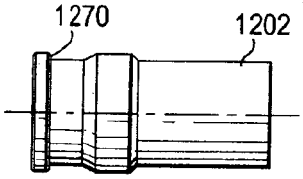
FIG. 12(E)
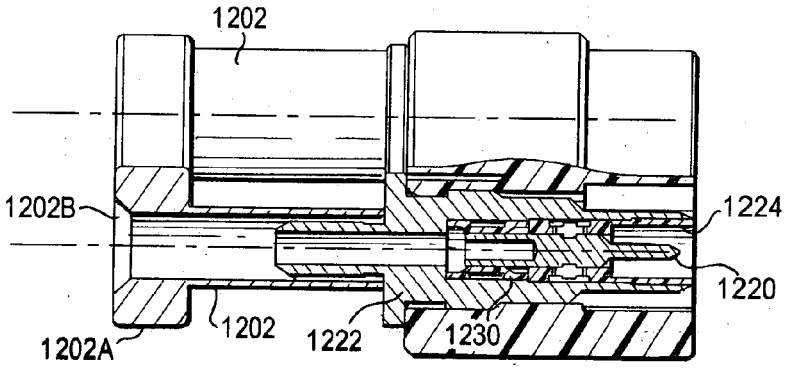
FIG. 12(B)
FIG. 12(C)
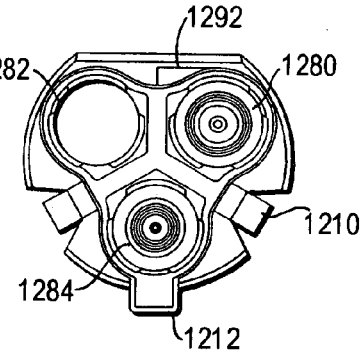

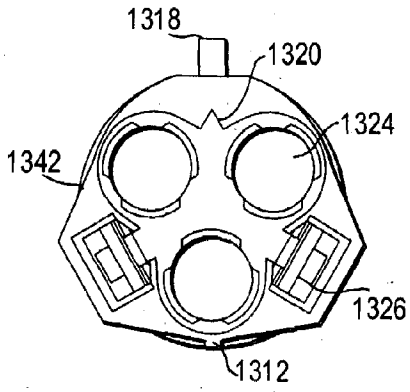
FIG. 13(A)
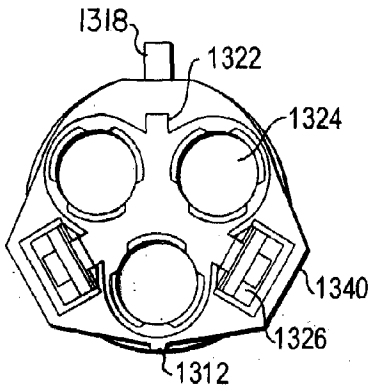
FIG. 13(B)
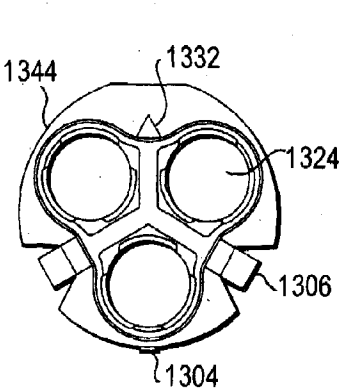
FIG. 13(C)
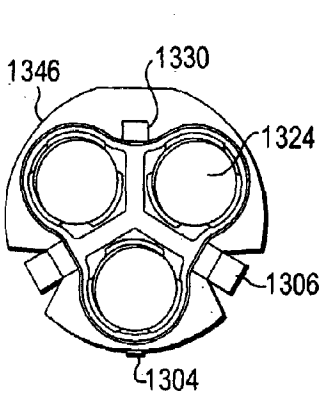
FIG. 13(D)
FIG. 14(A)
FIG. 14(B)
FIG. 14(C)
FIG. 14(D)

ELECTRICAL CONNECTOR WITH AN ANTI-SPLAY FERRULE

BACKGROUND OF THE INVENTION

The present invention is directed to an electrical connector. In the past, electrical connectors, sometimes referred to as FAKRA connectors, have been used to connect multiple coaxial cables. One such connector is illustrated in FIGS. 1(A)-1(F).

As illustrated in FIGS. 1(A)-1(F), the connectors include a male housing 108 and a female housing 100. Ferrules 102 are positioned adjacent to the male housing 108 and the female housing 100, respectively. Protrusion 106 on the male housing is adapted to engage latch 104 in the female housing 100.

By way of explanation, FIGS. 1(B) and 1(C) illustrate the connector assembly 110 in a state of pre-engagement and engagement, respectively. FIGS. 1(D) and 1(F) provide perspective views of the connector assembly 110 in a state of connection. FIGS. 1(A) and 1(C) illustrate cross-sectional views of the connector assembly 110 as taken along a midsection, where lines A-A throughout FIGS. 1(A)-1(F) correspond to each other.

However, several problems exist with the configurations illustrated in FIGS. 1(A)-1(F). For example, it is difficult to guarantee proper alignment of the male housing 108 and the female housing 100. Typically, these electrical connectors are installed on assembly lines, which tend to have limited lighting. Because the connectors illustrated in FIGS. 1(A)-1(F) do not include adequate alignment features, misalignment may often occur, which can result in electrical and mechanical damage to the connector assembly 110.

For example, elements 112 and 114 (FIG. 1(F)) may be used to provide a visual indication of alignment. However, elements 112 and 114 are not easily distinguished on a dimly lit assembly line, and simply provide a visual (not physical) aid to alignment. Although protrusion 118 may be used by an operator to identify the relative alignment of the female housing 100, there is no corresponding alignment feature on the male housing 108. As a result, inadequate alignment may occur.

Additionally, ferrules 102 cause undesirable wear and tear on the coaxial (or other) cables positioned therein. For example, throughout the life of the connector assembly 110, the coaxial cables experience friction against the ends of ferrules 102. Consequently, the insulation on the coaxial cables may deteriorate and may result in a short circuit, fire, or the like.

As can be seen in FIGS. 1(B), 1(C), 1(E), and 1(F) particularly, space exists between the ferrules 102. During normal use, it is quite likely that a user will grasp the end of the ferrules 102. Pressure applied at the ends of the ferrules causes the ends to become compressed together. This pressure also causes a corresponding splay of the opposite ends of the ferrules (e.g., at ports 140). This corresponding splay often results in misalignment between the ports 140 of the female housing 100 and the ports 140 of the male housing 108.

Another problem with the configurations illustrated in FIGS. 1(A)-1(F) is that the latch 104 is provided at the female housing 100. As a result, it is difficult to achieve secure engagement between the female housing 100 and the male housing 108. In the event that the latches 104 do engage protrusions 106, it becomes very difficult to disengage the connection. Effectively, the latch is a "lazy latch," which means that the latch often fails to return to its original position after disengagement.

Latches 104 are also subject to significant pressure during normal use. Due to the fragility of the configuration of latches 104, they frequently shatter during use. The latches 104 also fail to properly engage protrusions 106, which can result in failed electrical connections.

As illustrated in FIGS. 1(B) and 1(E), male housing 108 includes pin 120, which creates an electrical connection when received in socket 126 of the female housing 100. Conductive body 138 provides a second area of electrical connection when mated with conductive body 142 of the male housing 108 for electrically connecting the outer conductors in the coaxial cables being connected. Insulators 124 and 128 prevent undesired electrical contact between the inner and outer conductor.

Female housing 100 further includes retaining ring 134, which applies a resilient force at the mating end of ferrule 102. In more detail, when the pin 120 is received by receptacle 126, an outward stress is applied to the ferrule 102. Retaining ring 134 provides a spring-like force at the end of the ferrule 102 of the female housing 100 that strengthens the engagement between the female housing 100 and the male housing 108.

SUMMARY OF THE INVENTION

In light of the difficulties described above, the Applicants developed the present invention. To this end, a first non-limiting aspect of the invention provides an electrical connector, including: a female housing configured to include a first mating interface adapted to receive a second mating interface; a male housing configured to include the second mating interface; and at least one first anti-splay ferrule positioned at least one of the female housing and the male housing, wherein an electrical connection is achieved when the first mating interface receives the second mating interface.

Another aspect of the invention provides an electrical connector, including a female housing configured to include a first mating interface adapted to receive a second mating interface; a male housing configured to include the second mating interface; and at least one means for preventing electrical contact positioned at least one of the female housing and the male housing, wherein an electrical connection is achieved when the first mating interface receives the second mating interface.

BRIEF DESCRIPTION OF THE DRAWINGS

FIG. 4 is a front view of an exemplary configuration of a male housing according to the present invention;

FIGS. 11(A)-11(D) provide additional exemplary illustrations of a female housing according to the present invention;

FIGS. 12(A)-12(E) provide additional exemplary illustrations of a male housing according to the present invention;

FIGS. 13(A)-13(D) illustrate key codes according to the background art; and FIGS. 14(A)-14(D) illustrate key codes according to a non-limiting example of the present invention.

DESCRIPTION OF THE EMBODIMENTS

Figure 1A:
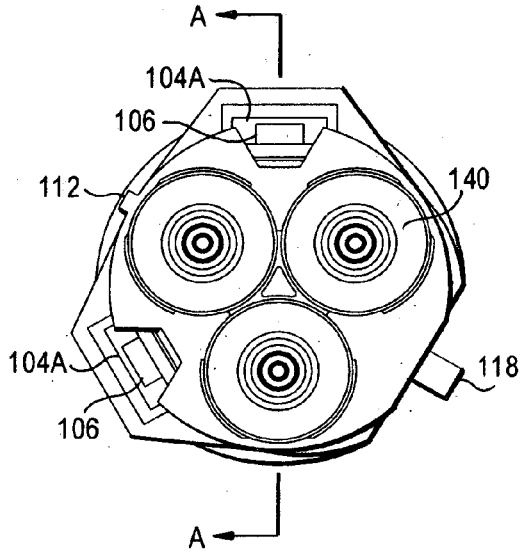
FIG. 1(A) Background Art
FIGS. 1(A)-1(F) illustrate a connector according to the background art.
Figure 1B:
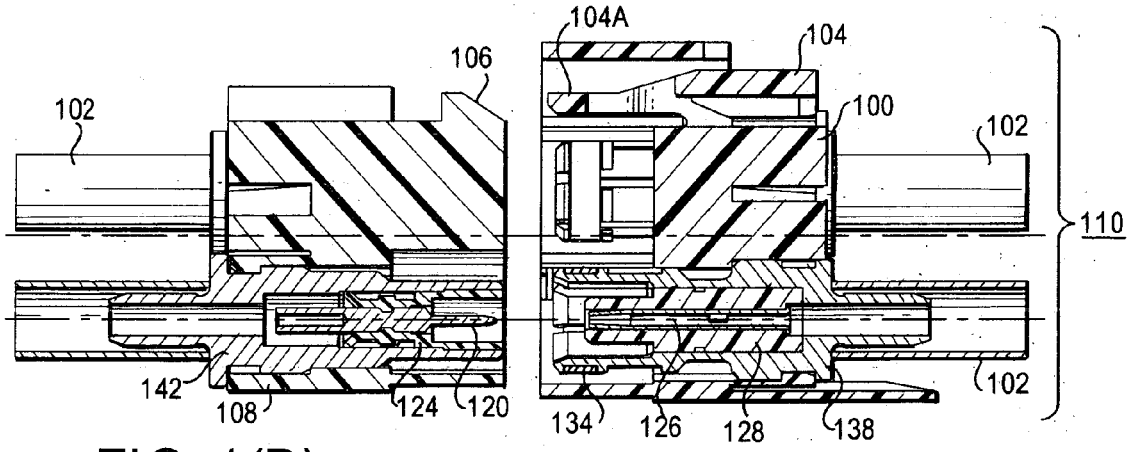
FIG. 1(B) Background Art
Figure 1C:
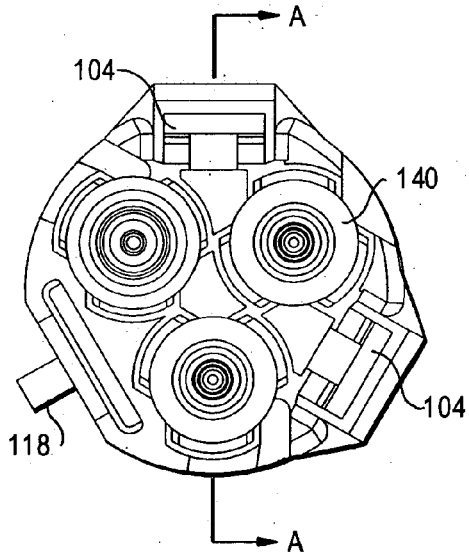
FIG. 1(C) Background Art
Figure 1D:
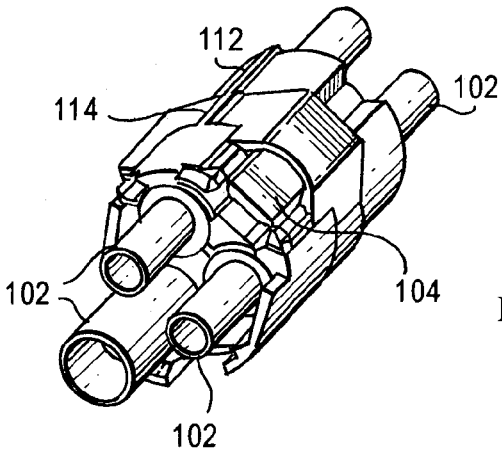
FIG. 1(D) Background Art
Figure 1E:
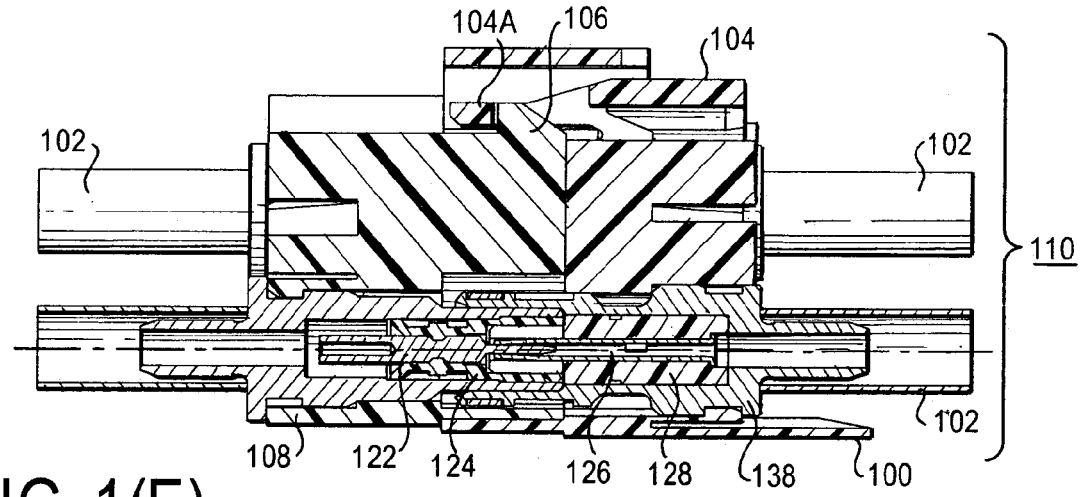
FIG. 1(E) Background Art
Figure 1F:
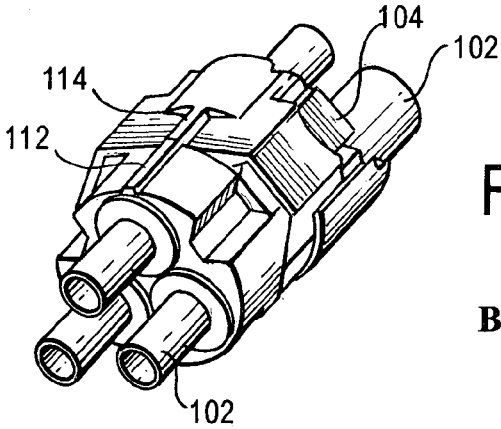
FIG. 1(F) Background Art

In the following description of the exemplary embodiments, like reference numerals refer to like elements throughout.

FIGS. 2(A)-2(F) illustrate several views of the electrical connector according to a first non-limiting embodiment of the present invention. According to the configurations illustrated in FIGS. 2(A)-2(F), it is possible to improve the mating characteristics between coaxial cables. In each of the embodiments described herein, it is possible that the ferrules (e.g., ferrules 202) may have different diameters as desired to accommodate different sized coaxial cables. In FIGS. 2(A)-2(F), lines A-A correspond throughout.

To this end, as illustrated in FIGS. 2(A) through 2(F), the connector assembly 210 includes a male housing 208 and a female housing 200. Ferrules 202, which may be made of any suitable material, are positioned adjacent to the male housing 208 and the female housing 200, respectively, coaxial with the end portion of conductive bodies 238 and 222. Ferrules 202 may be made of a metal, a polymer, or any combination thereof, and preferably include wider anti-splay portions (e.g., flanges) 202A. By including these wider portions 202A, wear and tear (e.g., wear and tear caused by bending stress) on the coaxial cables (not shown) fed therethrough may be significantly reduced.

Figure 2C:
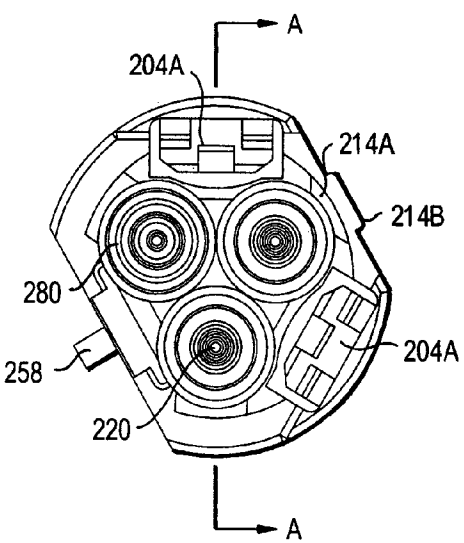
FIGS. 2(A)-2(F) illustrate non-limiting exemplary configurations of the connector according to the present invention.
Figure 2A:
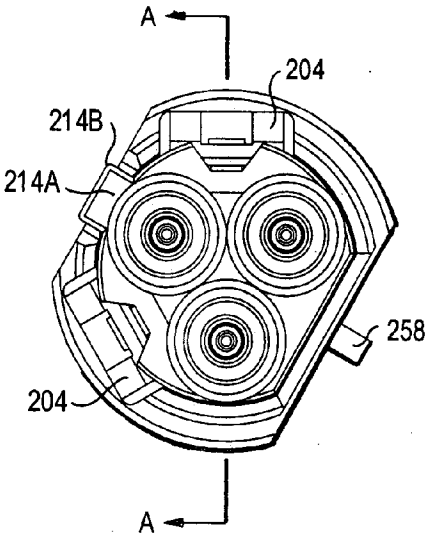
Figure 2B:
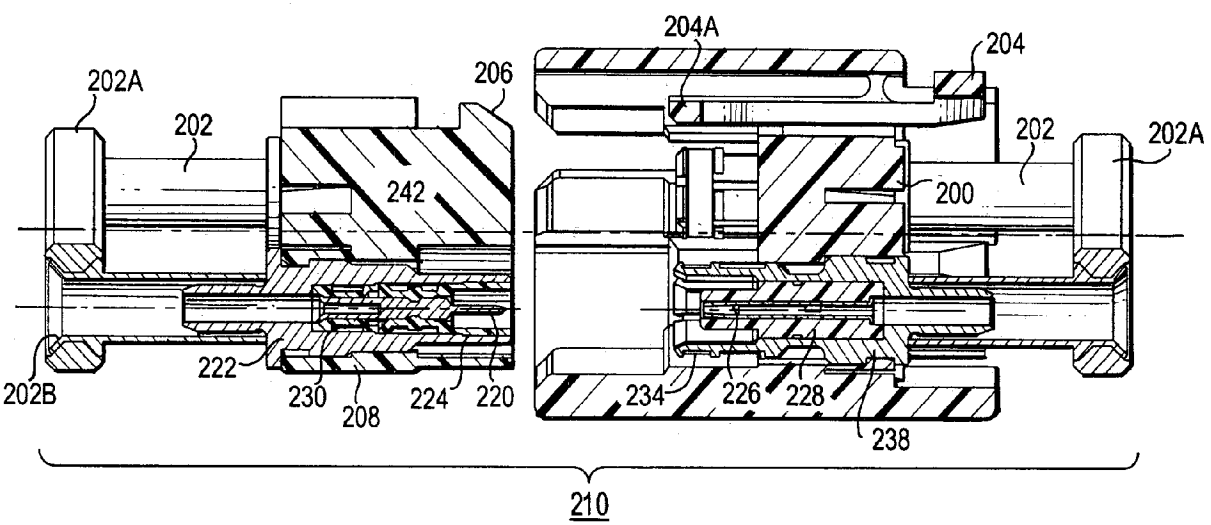
Figure 2D:
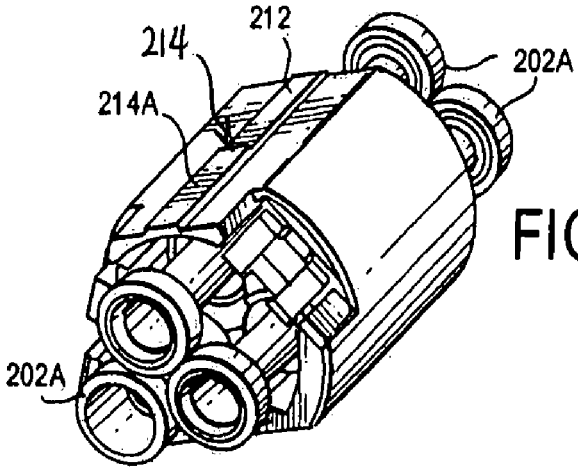
Figure 2E:
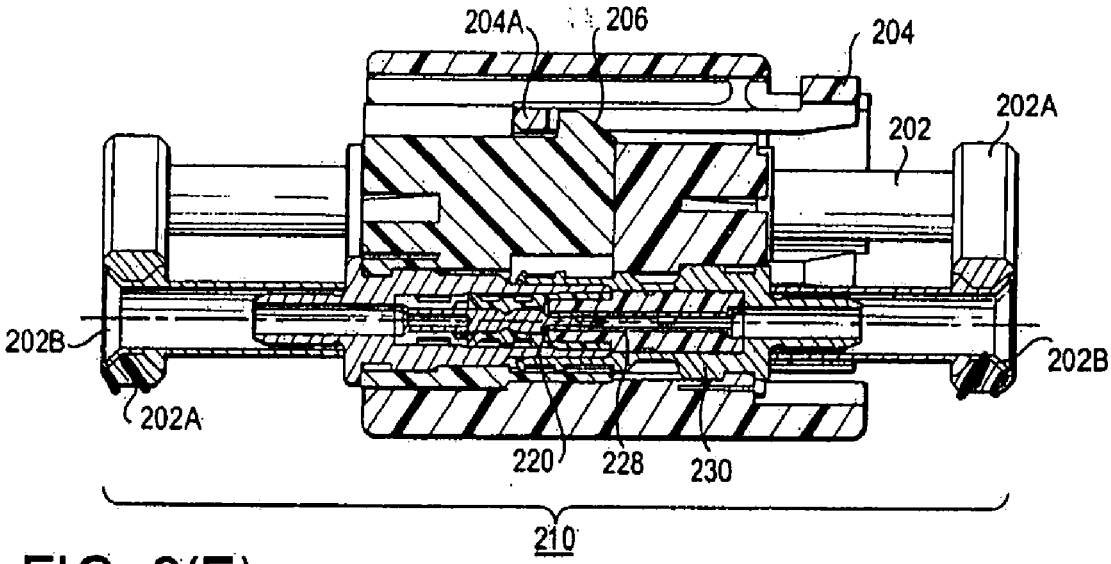
Figure 2F:
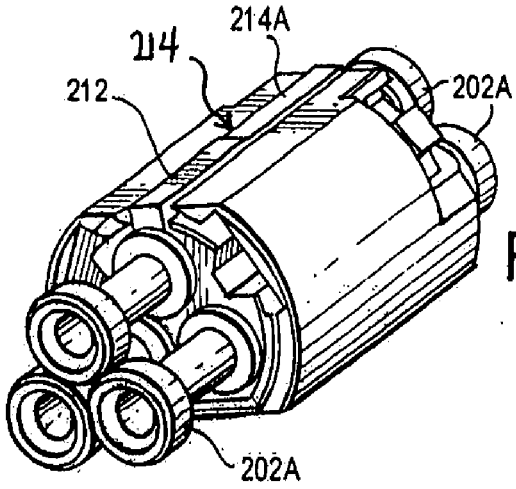

As illustrated in FIGS. 2(B) and 2(F), anti-splay portions 202A may include beveled inner diameters 202B to further reduce bending stress and wear and tear on the coaxial cables. However, other configurations, such as rounded edges on inner diameters 202B, are within the scope of the present invention. In addition to reducing damage to the coaxial cables, anti-splay portions 202A also reduce the risk that ports 280 may become misaligned due to pressure applied at the ends of ferrules 202. Because anti-splay portions 202A generally abut each other, the relative positioning of the ferrules 202 does not change if a force is applied at or near anti-splay portions 202A (for example, when a user grasps either the female housing 200 or the male housing 208).

The connector assemblies 210 further include protrusion 206, which is adapted to engage latch 204. As shown in FIGS. 2(B) and 2(E), the latch 204 is mounted to an outer surface of the female housing 200. In other words, the latch 204 is mounted upside down as compared to the latch 104 of the background art.

By configuring the female housing to include the latch 204 as illustrated, the lazy latch problem of the background art is eliminated because the latch may more freely return to its original position. Additionally, fracture of the assembly 210 during use is reduced. Fewer fractures occur because inverting the positioning of the latch 204 enables the latch 204 to be lengthened and widened. This, in turn, reduces the stress on the latch itself. By including gripper portion 204A on latch 204, secure engagement with protrusion 206 may be achieved.

Connector assembly 210 includes keying features 212 and 214, shown in FIGS. 2(D) and 2(F). Because the connector assembly 210 is often assembled on a dimly lit assembly line, the keying features 212 and 214 enable improved alignment between the male housing 208 and the female housing 200. In more detail, keying feature 214 of the female housing can be divided into two subparts (214A and 214B). Subpart 214B includes a slot into which keying feature 212 may be guided. Subpart 214A provides a visual indication of alignment, for example with a colored stripe. Thus, as shown in FIGS. 2(D) and 2(F), keying feature 212, when engaged, may be contained at least partially within subpart 214B and may be visually aligned with keying feature 214A.

Additionally, alignment protrusion 258 may be used to determine the relative alignment of female housing 200. It is also possible to include a visual indicator on the keying feature (or elsewhere on the connector assembly 210), such as an alignment stripe. Preferably, the alignment stripe may be colored differently than the connector assembly 210 to enable easier recognition of alignment.

As a further modification, electrical isolation elements may be included in the anti-splay ferrules 202. By including an electrical isolation element (e.g., elements 202A and 202B), it is possible to prevent accidental and/or undesirable electrical contact between elements of the connector assembly 210. Although all of the ports 280 in FIGS. 2(A)-2(F) are illustrated as populated by ferrules 202, it is possible to leave one or more ports 280 unpopulated, as desired.

As shown in FIGS. 2(B) and 2(C), male housing 208 includes pin 220 that provides an electrical connection when received by receptacle 226. Conductive body 222 provides an additional electrical connection when engaged with conductive body 238 for the outer conductors of coaxial cable, and insulators 228, 230, and 242 prevent undesired electrical contact between the inner and outer conductive elements.

Retaining ring 234 may also be provided, as illustrated in FIG. 2(B). Like retaining ring 134, retaining ring 234 provides a more secure engagement between female housing 200 and male housing 208.

Figure 3:
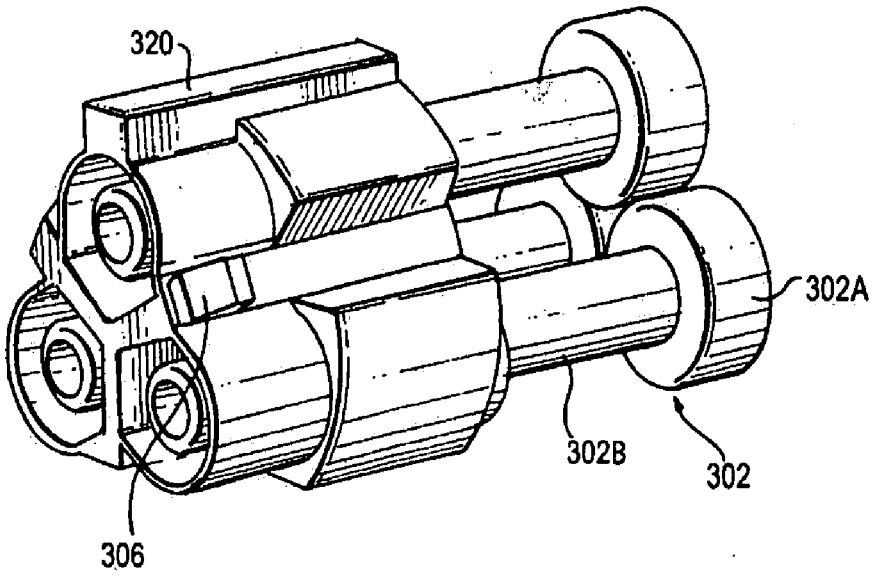
FIG. 3 provides a non-limiting example of a configuration of a male housing according to the present invention.

FIG. 3 provides an enlarged illustration of a male housing according to an aspect of the present invention. The male housing 308 of this embodiment may be incorporated into any other embodiment of the present invention.

As shown in detail in FIG. 3, the end portions 302A of anti-splay ferrules 302 have larger diameters than the body portions 302B. The keying feature 320 enables improved alignment, as described above with respect to elements 212 and 214 of FIG. 2(E). Keying feature 320 provides early engagement with the female housing (not shown), and may optionally include an alignment stripe of a desired color to provide a visual indication of engagement. Protrusions 306 are adapted to engage the latch elements of the female housing (see, e.g., FIG. 5).

FIG. 4 provides another illustration of an exemplary male housing of the present invention. Like the male housing of FIG. 3, the male housing of FIG. 4 may be incorporated into the connector assemblies of any of the embodiments of the present invention.

As shown in FIG. 4, protrusions 406 and 408 may be positioned on both sides of keying feature 420. However, alternative configurations of the protrusions 406 and 408 are also within the scope of the present invention. For example, it may be desirable to include a third protrusion (not shown), or only one protrusion 406 or 408. Additionally, it is possible not to include any protrusions, if that is desirable for the intended use of the connector assembly.

Figure 5:
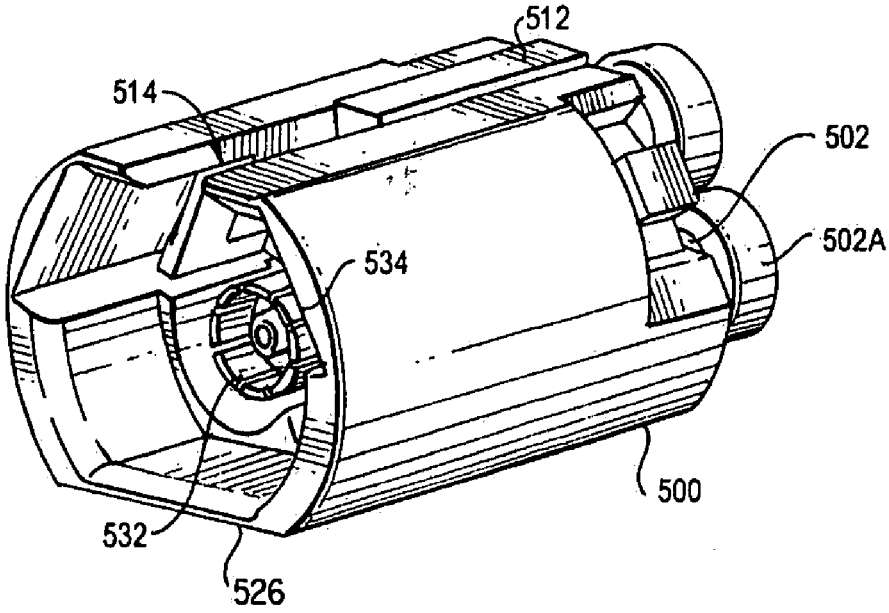
FIG. 5 is an illustration of a non-limiting example of a female housing according to the present invention.

FIG. 5 provides a more detailed illustration of an exemplary female housing 500 according to the present invention. As shown in FIG. 5, the latch 534 may be wider than the latches of the background art. This wider latch geometry enables improved alignment and engagement between the female housing 500 and a corresponding male housing (not shown). As described with respect to the other embodiments, flanges 502A (anti-splay portions 502A) are configured to reduce wear and tear on coaxial cables, which are provided therein (not shown).

Additionally, the female housing 500 includes a shrouded mating face 526, which enables early alignment between the female housing 500 and a male housing. Similarly, the enlarged lead chamfer provides a larger target for a corresponding male housing. Finally, tighter interface criteria in the electrical engagement modules 532 (e.g., the mating ends of ferrules 502) enable secure engagement between the female housing 500 and a male housing. Due to the tighter interface criteria, less force is required to achieve a secure electrical engagement.

The male housing shown in FIG. 3 and the female housing shown in FIG. 5, respectively, also include lengthened ferrules 302 and 502. By increasing the length of the ferrules 302 and 502, it may be possible to further reduce strain and wear and tear on the connector assemblies when in use.

Figure 6:
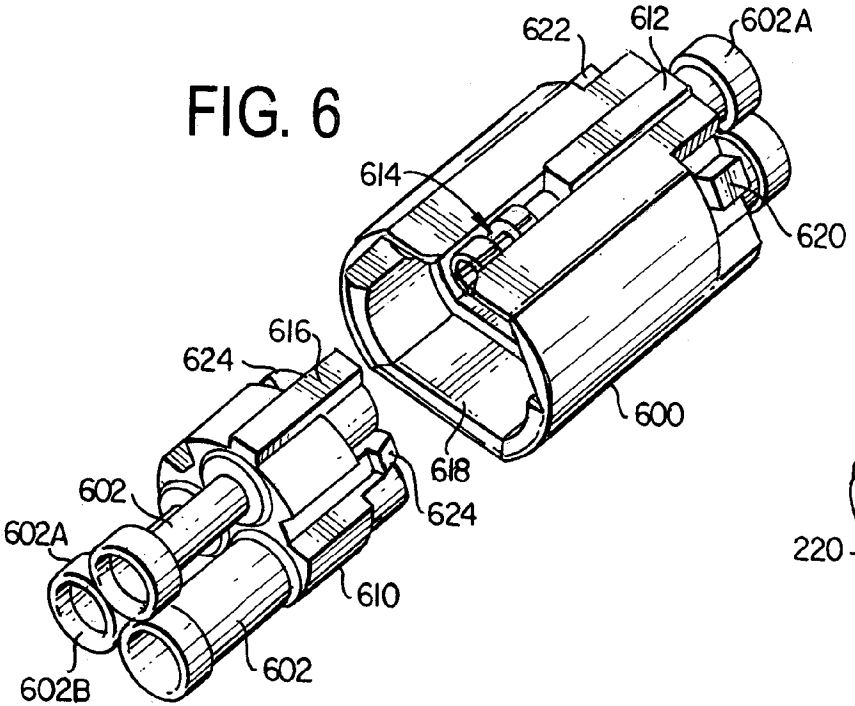
FIG. 6 illustrates an exemplary male housing and an exemplary female housing in a state of pre-alignment according to the present invention.

FIG. 6 provides another illustration of a connector assembly according to the present invention. As shown in FIG. 6, female housing 600 is configured to mate with male housing 610. To enable a secure engagement of the housings, female housing 600 is provided with shrouded mating face 618, as well as alignment guides 612 and 614. The alignment guide 616, which may be configured to protrude from the male housing 610, is adapted to engage alignment guide 614. Alignment guides 612 and 616 also provide a visual indication of alignment due to their different coloring relative to the female housing 600 and the male housing 610.

Ferrules 602, as described above with respect to other embodiments, are shown as being of different sizes. However, it is possible to provide ferrules having identical sizes, if desired. Additionally, it is possible to have the ferrules of the female housing be of different sizes with respect to each other while the ferrules of the male housing may be of the same size relative to each other and/or relative to at least one of the ferrules of the female housing. Of course, other configurations of the ferrule sizes are also within the scope of the present invention. Ferrules 602 also include beveled edges 602B on the inner diameters of the flanges 602A.

If separation of the female housing 600 and the male housing 610 is desired after the housings have been connected, it is possible to press latch releases 620 and/or 622. Once the latch releases have been pressed, the latches disengage from protrusions 624 on the male housing 610. While two latch releases and two protrusions are illustrated in FIG. 6, other quantities and/or positions of the latch releases and protrusions are within the scope of the present invention.

Figure 7A:
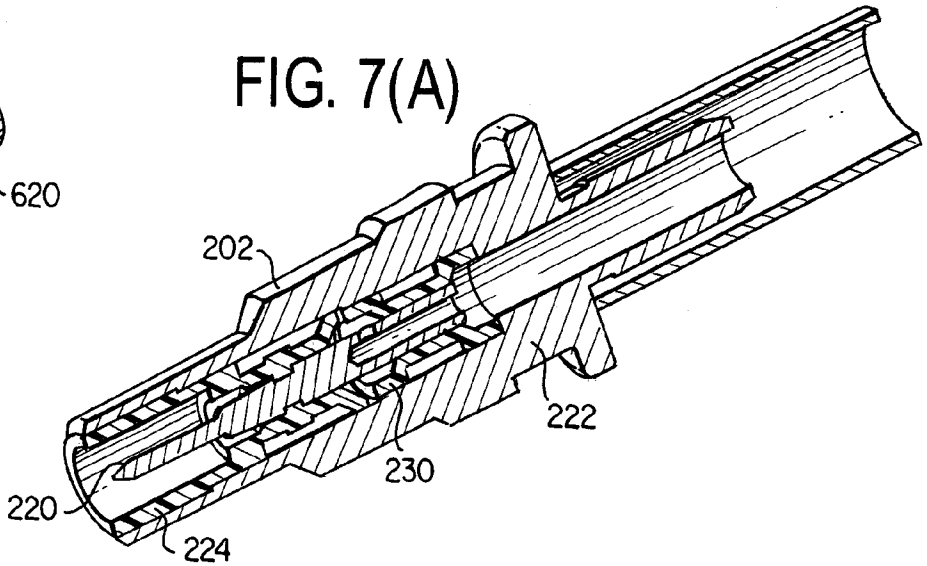
FIGS. 7(A) and 7(B) illustrate exemplary ferrule inner configurations when a female housing and a male housing are connected.
Figure 7B:
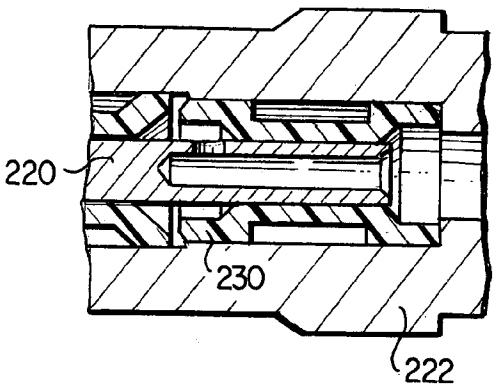

FIG. 7(A) provides a detailed view of the insulator 230, which may be added to improve axial alignment to reduce the concentricity of the center contact due to errors in cable preparation, variations in dielectric diameters, and component tolerances. FIG. 7(B) provides a schematic illustration of the ferrule 202, which more clearly illustrates the relationships between insulator 230, conductive body 222, and pin 220.

Of course, the location of insulator 230 is not limited to the location shown in FIGS. 7(A) and 7(B). Preferably, the insulator is coaxial to the pin. However, the insulator is not limited in axial position.

Figure 8A:
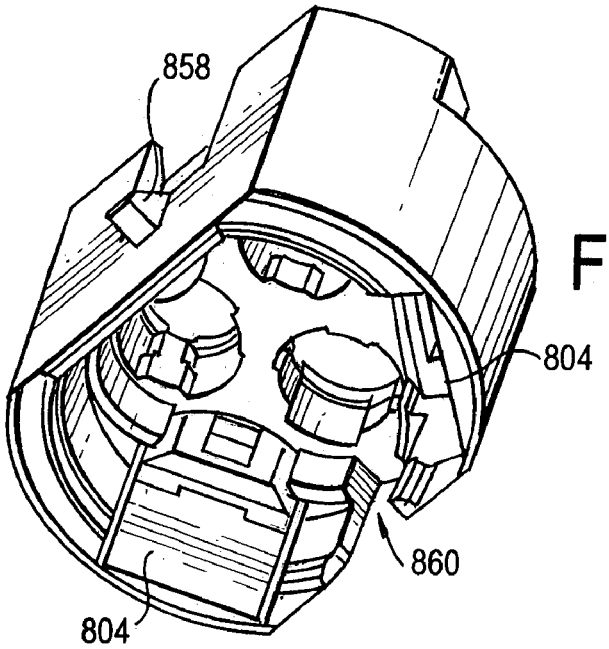
FIGS. 8(A)-8(C) provide more detailed illustrations of an exemplary latch configuration.
Figure 8B:
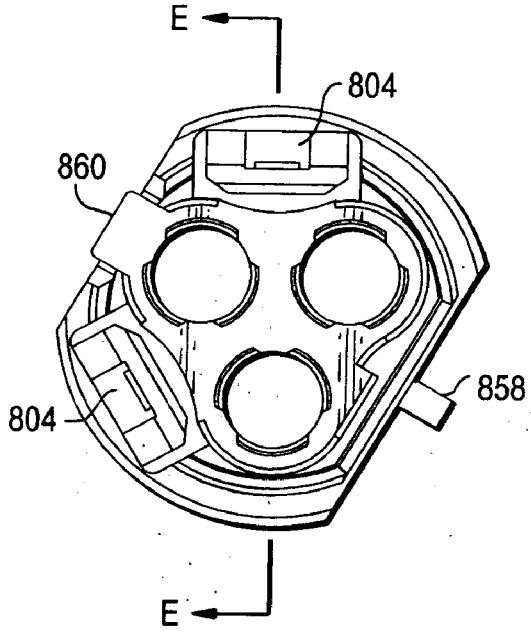
Figure 8C:
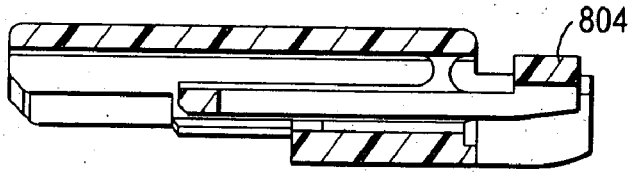

FIGS. 8(A)-8(C) provide additional illustrations of the female housing latch geometry. As these figures illustrate, latch 804 is mounted to an exterior surface of the female housing. Like the other embodiments described above, alignment features 858 and 860 enable improved alignment of the female housing with a male housing (not shown) during connection of the assemblies.

Figure 9A:
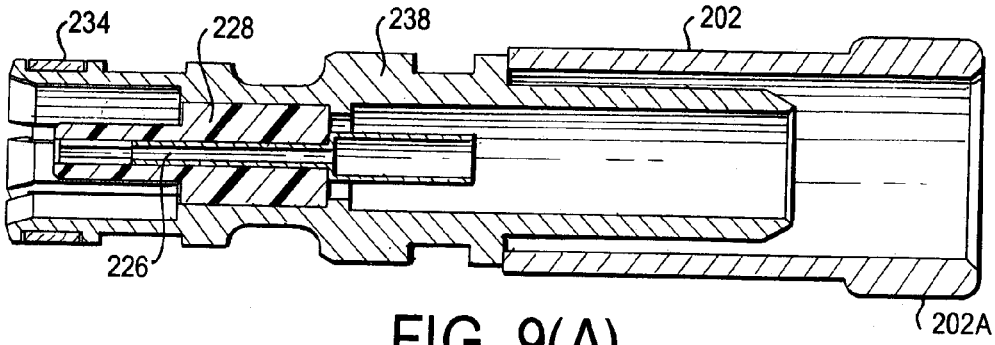
FIG. 9(A) illustrates an exemplary inner configuration of a ferrule in a female housing and FIG. 9(B) illustrates a perspective view of the ferrule.

FIG. 9(A) provides a more detailed illustration of ferrule 202 in female housing 200. As shown in FIG. 9(A), retaining ring 234 is positioned at or near an end of the mating end of the ferrule 202. However, other suitable positions of the retaining ring are within the scope of this invention.

Additionally, conductive body 238 provides an electrical connection between the coaxial cables (not shown) when the female housing 200 is mated with a corresponding male housing. Receptacle 226, made of a conductive material, provides a second electrical connection between the coaxial cables.

Figure 9B:
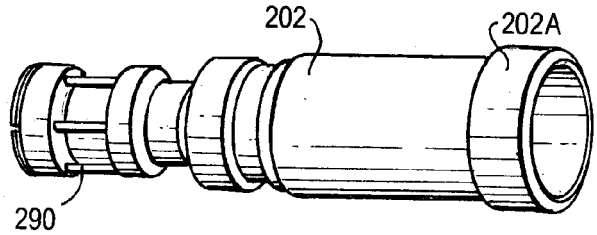

As shown in FIG. 9(B), the mating end 290 of ferrule 202 may be flexible. This flexibility may be achieved, for example, by making mating end 290 of a non-contiguous material.

Figure 10A:
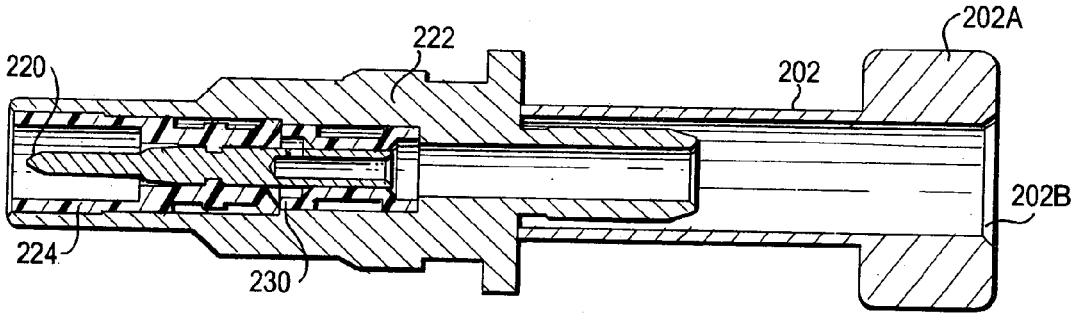
FIG. 10(A) illustrates an exemplary inner configuration of a ferrule in a male housing and FIG. 10(B) illustrates a perspective view of the ferrule.
Figure 10B:
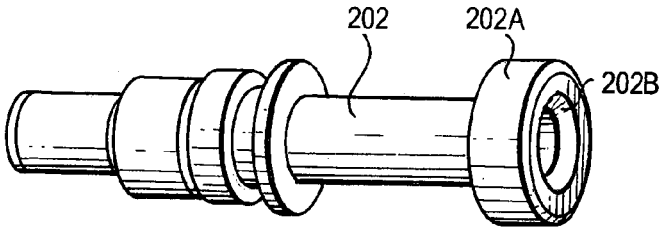

FIG. 10(A) provides yet another illustration of the connection elements of male housing 208. Because the elements of FIG. 10(A) were described in detail above, a detailed description herein is omitted. FIG. 10(B) provides a perspective view of ferrule 202 of the male housing 208.

FIGS. 11(A)-11(D) illustrate yet another embodiment of the present invention. The female housing of this non-limiting embodiment may be equally substituted into any of the other embodiments described herein.

Figure 11A:
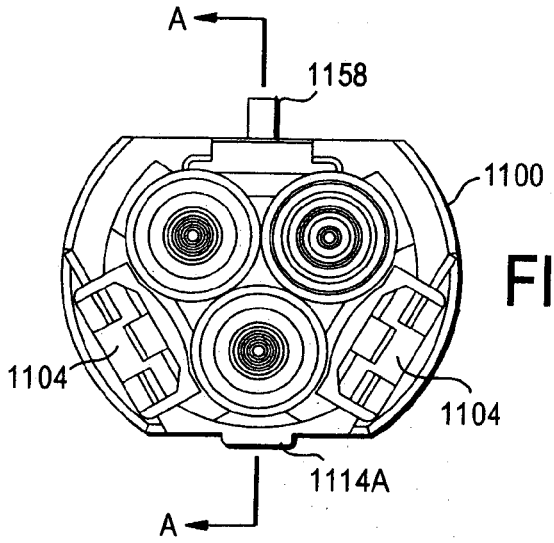
Figure 11B:
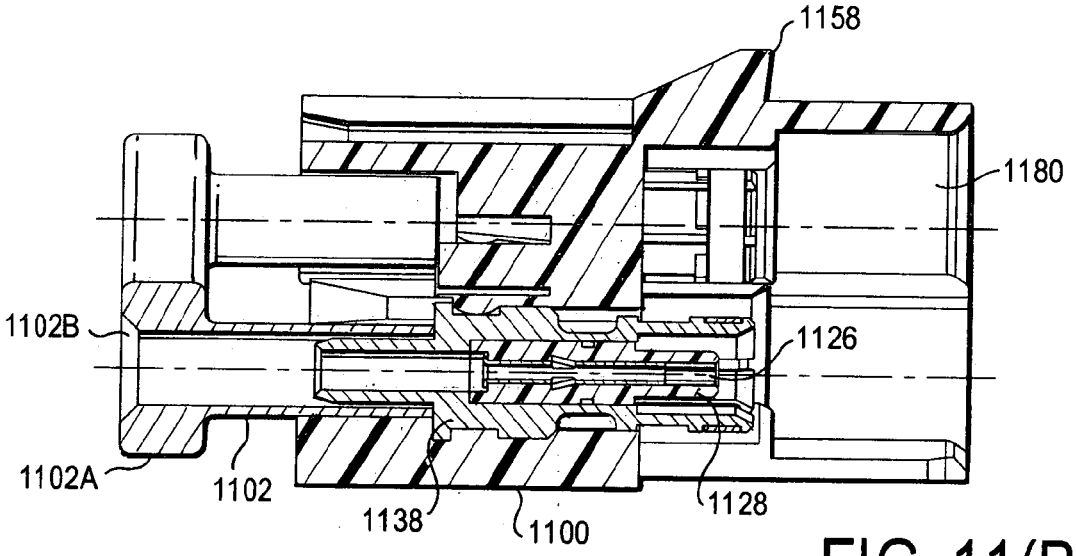

As shown in FIG. 11(A), which shows a rear view of the female housing 1100, the female housing 1100 includes latches 1104, as well as alignment guides 1114A and 1158. Alignment feature 1114A is also illustrated in FIG. 11(D), as is alignment groove 1114B.

It is important to note that any of the ports may be populated or not populated, as desired. For example, port 1184 is shown unpopulated, while port 1180 (e.g., where the mating end of ferrule 1102 is positioned) is shown populated.

Like the other exemplary embodiments, ferrules 1102 include flanges 1102A (anti-splay portions 1102A) and optionally beveled inner diameters 1102B. Conductive receptacle 1126, conductive body 1138, and insulator 1128 are also provided.

Figure 11C:
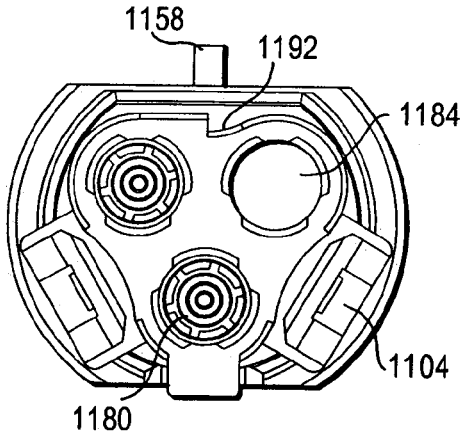

As shown in FIG. 11(C), an additional alignment feature may be provided in the female housing. Alignment feature 1192 is adapted to prevent misalignment of the ferrules 1102 during mating with a male housing. In more detail, the alignment feature 1192 may be a plastic protrusion or configuration in the interior of the female housing 1100. Because the protrusion must be properly aligned with the corresponding surface of the male housing, it is not possible to improperly mate the female housing 1100 with a male housing. In other words, if the female housing 1100 is not in proper alignment with the male housing during mating, the alignment feature 1192 will prohibit the female housing 1100 from connecting to the male housing.

Additionally, the height and/or width of the alignment feature 1192 may be set such that the mating ends of ferrules 1102 do not accidentally contact an improperly aligned ferrule from a corresponding male housing. In this way, it is possible to prevent damage to the connection elements.

FIGS. 12(A)-12(E) provide additional partial views of an exemplary male housing 1208 according to the present invention. The male housing 1208 may be incorporated into any other embodiment discussed herein.

As shown in FIG. 12(A), the female housing includes three ports, 1280, 1282, and 1284. A view from the opposite end of the ports is shown in FIG. 12(C). Of course, more or less ports may be included, as desired, and any combination of ports may be populated or unpopulated. In this non-limiting example, port 1282 is shown unpopulated.

Male housing 1208 may also include alignment guide 1212, which provides a visual indication of successful alignment when mated with a corresponding female housing (not shown). Alignment feature 1292 may also be included, as illustrated in FIG. 12(C). Alignment feature 1292 may include, for example, a plastic protrusion on the male housing 1208. Of course, other materials and methods of implementing alignment feature 1292 are also within the scope of this invention. The height and other dimensions of the alignment feature 1292 may be selected such that the mating end 1270 of the ferrules 1202 is not damaged if improper alignment occurs. In other words, alignment feature 1292 prevents engagement of the male housing 1208 with a female housing, even if excessive force is applied.

Like the embodiments described above, ferrules 1202 preferably include flanges 1202A and beveled inner diameters 1202B, as shown in FIG. 12(B). Mating end 1270 of ferrule 1202 is illustrated in FIG. 12(E). Additional alignment features 1210 provide a tactile and visual indication of proper alignment of the male housing 1208.

Pin 1220 provides a first electrical connection between male housing 1208 and a female housing. Conductive body 1222 provides a second electrical connection between male housing 1208 and a female housing. Insulators 1230 and 1224 prevent undesired electrical contact between elements of the male housing.

FIGS. 13(A)-13(D) provide illustrations of exemplary key codes according to the background art. In more detail, FIGS. 13(A) and 13(B) depicted female housings 1342 and 1340, respectively. As shown in FIGS. 13(A) and 13(B), the female housings include latches 1326, alignment guides 1312 and 1318, and ports 1324. Ports 1324 may be populated or unpopulated, as desired. Additionally, keys 1320 and 1322 are present to prevent misalignment with male housings 1344 and 1346, respectively. However, keys 1332 and 1330 in male housings 1344 and 1346 (shown in FIGS. 13(C) and 13(D)) may be overcome by brute force and misalignment may occur. In other words, it is possible to improperly mate key 1320 with key 1330 and to improperly mate key 1332 with key 1322. Male housings 1344 and 1346 each include ports 1324 (which may be populated or unpopulated as desired), protrusions 1306 adapted to engage latches 1326, and alignment guides 1304.

FIGS. 14(A)-14(D) illustrate male and female housings according to a non-limiting example of the present invention. As shown in FIGS. 14(A) and 14(B), female housings 1442 and 1440 include keys 1420 and 1422, respectively. Male housings 1444 and 1446 include corresponding keys 1432 and 1430, respectively. Through the improved configurations of FIGS. 14(A)-14(D), misalignment achieved by brute force is prevented.

Male housings 1444 and 1446 further include ports 1424 (populated or unpopulated as desired), protrusions 1406, and alignment guides 1412. Female housings 1442 and 1440 each include ports 1424 (also populated or unpopulated as desired), latches 1426, which are adapted to engage protrusions 1406 of the male housings 1444 and 1446 (respectively), and alignment guides 1418.

Additional advantages and modifications will readily occur to those skilled in the art. Therefore, the invention in its broader aspect is not limited to the specific details and representative embodiments shown and described herein. Accordingly, various modifications may be made without departing from the spirit or scope of the general inventive concept as defined by the appended claims and their equivalents.

What is claimed is:

1. An electrical connector, comprising:

a female housing configured to include a first mating interface adapted to receive a second mating interface;

a male housing configured to include the second mating interface; and a plurality of anti-splay ferrules positioned at least one of the female housing and the male housing, each of the plurality of anti-splay ferrules having an anti-splay portion, the anti-splay portions being substantially adjacent to and in contact with one another thereby restricting movement of the anti-splay ferrules;

wherein an electrical connection is achieved when the first mating interface receives the second mating interface.

2. The electrical connector according to claim 1, wherein the female housing further comprises at least one latch positioned at the housing and configured to secure the connection between the first mating interface and the second mating interface.

3. The electrical connector according to claim 2, wherein the at least one latch includes a plurality of latches.

4. The electrical connector according to claim 2, wherein the at least one latch is comprised at least in part of a rigid material.

5. The electrical connector according to claim 2, wherein the at least one latch is at least partially flexible.

6. The electrical connector according to claim 1, wherein the plurality of anti-splay ferrules are positioned on the male housing, each of the plurality of anti-splay ferrules having an anti-splay portion, the anti-splay portions being substantially adjacent to and in contact with one another thereby restricting movement of the anti-splay ferrules.

7. The electrical connector according to claim 1, wherein the plurality of anti-splay ferrules are positioned on the female housing, each of the plurality of anti-splay ferrules having an anti-splay portion, the anti-splay portion being substantially adjacent to and in contact with one another thereby restricting movement of the anti-splay ferrules.

8. The electrical connector according to claim 1, wherein the plurality of anti-splay ferrules are coupled to their respective housing at one end and the anti-splay portions are disposed at the opposite end so that each of the plurality of anti-splay ferrules maintain their position relative to each other.

9. The electrical connector according to claim 1, wherein the female housing includes at least one first alignment guide.

10. The electrical connector according to claim 9, wherein the male housing includes at least one second alignment guide.

11. The electrical connector according to claim 10, wherein at least one of the at least one first alignment guide and the at least one second alignment guide includes a key.

12. The electrical connector according to claim 9, wherein the at least one first alignment guide includes a key.

13. The electrical connector according to claim 10, wherein at least one of the at least one first alignment guide and the at least one second alignment guide provides a visual indication of alignment.

14. The electrical connector of claim 1, wherein at least a portion of the female housing protrudes beyond the mating interface, thereby protecting the mating interface and improving alignment.

15. The electrical connector of claim 1, wherein at least one of the female housing and the male housing includes a protrusion configured to prohibit mating if the female housing and the male housing are not aligned.

16. An electrical connector of claim 1, further comprising:

a latch adapted to engage a protruding member, the latch disposed on an inner wall of an outer surface of one of the female housing and the male housing, the protruding member disposed on one of the second mating interface and first mating interface.

17. The electrical connector of claim 16, further comprising means for aligning the male housing and the female housing.

18. The electrical connector of claim 17, wherein the means for aligning includes means for visually indicating alignment.

19. The electrical connector of claim 17, wherein the means for aligning includes means for physically preventing misalignment.

20. The electrical connector of claim 16, wherein at least one of the female housing and the male housing is adapted to receive at least one coaxial cable.

21. The electrical connector of claim 1, wherein the portions of the anti-splay ferrules which are in contact with one another comprise electrical isolation elements.

* * * * *